US006197387B1

(12) United States Patent
Fiedler et al.

(10) Patent No.: US 6,197,387 B1
(45) Date of Patent: Mar. 6, 2001

(54) METHOD TO PREPARE THE PRODUCTION OF STRUCTURED METAL COATINGS USING PROTEINS

(75) Inventors: Stefan Fiedler, Berlin; Dieter Oesterhelt, Munich; Heinrich Meyer, Berlin; Wolfgang Scheel, Berlin; Herbert Reichl, Berlin, all of (DE)

(73) Assignees: Fraunhofer-Gesellschaft Zur Foerderung Der Angewandten Forschung E. V., Munich; Atotech Deutschland GmbH, Berlin, both of (DE)

( * ) Notice: Subject to any disclaimer, the term of this patent is extended or adjusted under 35 U.S.C. 154(b) by 0 days.

(21) Appl. No.: 09/284,489

(22) PCT Filed: Oct. 27, 1997

(86) PCT No.: PCT/DE97/02494

§ 371 Date: Jul. 1, 1999

§ 102(e) Date: Jul. 1, 1999

(87) PCT Pub. No.: WO98/19217

PCT Pub. Date: May 7, 1998

(30) Foreign Application Priority Data

Oct. 25, 1996 (DE) ..... 196 44 516

(51) Int. Cl.[7] ..... B05D 3/06
(52) U.S. Cl. ..... 427/532; 427/404; 427/414
(58) Field of Search ..... 427/532, 404, 427/414

(56) References Cited

U.S. PATENT DOCUMENTS

| | | |
|---|---|---|
| 4,084,967 | 4/1978 | O'Brien . |
| 4,103,064 | 7/1978 | McAlear et al. . |
| 4,103,073 | 7/1978 | McAlear et al. . |
| 4,314,021 | 2/1982 | O'Brien et al. . |
| 4,356,256 | 10/1982 | O'Brien et al. . |
| 4,728,591 | 3/1988 | Clark et al. . |
| 4,965,174 | 10/1990 | Arai et al. . |
| 5,041,224 | 8/1991 | Ohyama et al. . |
| 5,518,858 | 5/1996 | Drykova et al. . |

FOREIGN PATENT DOCUMENTS

| | | |
|---|---|---|
| 0293947A1 | 7/1988 | (EP) . |
| 2196143A | 4/1988 | (GB) . |
| 06234626 | 8/1994 | (JP) . |
| 02104600 | 4/1999 | (JP) . |

OTHER PUBLICATIONS

El–Sayed, Int. J. Quantum Chem., Quantum Chem. Symp. vol. 22, pp 367–375, 1988.*

Morgan et al., "Photo–Patterning of Sensor Surfaces With Biomolecular Structures: Characterisation Using AFM and Fluorescence Microscopy", *Biosensors & Bioelectronics* (1995) pp 841–846.

(List continued on next page.)

*Primary Examiner*—Erma Cameron
(74) *Attorney, Agent, or Firm*—Foley & Lardner

(57) ABSTRACT

The invention relates to the production of thin metal layers and structures thereof on substrates of various structures. The lateral extent of a metal layer on the respective substrate can be prescribed with a precision in the micron and submicron range. The method described makes it possible to manufacture flat and three-dimensional metal structures on smooth planar or curved surfaces, as are required, for example, for depicting writing or drawings. The method uses no printing techniques.

20 Claims, 2 Drawing Sheets

1 2
3 4 5

OTHER PUBLICATIONS

Schnur, "Lipid Tubules: A Paradigm for Molecularly Engineered Structures", *Science vol. 262*, (1993) pp 1669–1675.
Menz et al., "Mikrosystemtechnik fur Ingenieure", pp. X–XIV, (1993).
Becker et al., fabrication of Microstructures With High Aspect Ratios And Great Structural Heights By Synchrotron Radiation Lithography, Galvanoforming, And Plastic Moulding (LIGA Process), *Microelectronic Engineering*, vol. 4:35–56, (1986).
Soekarno et al., "Pathfinding By Neuroblastoma Cells In Culture Is Directed By Preferential Adhesion To Positively Charged surfaces", *Neuroimage*, vol. 1:129–144, (1993).
Lom et al., "A Versatile Technique For Patterning Biomolecules Onto Glass Coverslips", *Journal Of Neuroscience Methods*, vol. 50:385–397, (1993).
Pritchard et al., "Immobilisierung von Biomolekuelen In Zweidimensionalen Mustern Im Mikrometermassstab", *Agnew. Chem.*, vol. 107:84–86, (1995).
Mann et al., "Crystallization At Inorganic–Organic Interfaces: Biominerals And Biomimetic Synthesis",*Science*, vol. 261:1287–1292, (1993).
Schnur, "Lipid Tubules: A Paradigm For Molecularly Engineered Structures", *Science*, vol. 262:1669–1676, (1993).
Oesterhelt, "Structure and Function Of Halorhodopsin", *Israel Journal Of Chemistry*, vol. 35:475–494, (1995).
Sasaki et al., "Conversion Of Bacteriorhodopsin Into A Chloride Lon Pump", *Science*, vol. 269:73–75, (1995).
Ikonen, "Bacteriorhodopsin In Langmuir–Blodgett Films–Preparation, Structure And Photoinduced Optical And Electrical Properties", pp. 1–27, (1993).
Hwang et al., "Purple Membrane Vesicles: Morphology And Proton Translocation", *J. Membrane Biol.*, vol. 33:325–350, (1977).
Jain et al., "The Spontaneous Incorporation Of Protein Into Preformed Bilayers", *Biochimica et Biophysica Acta*, vol. 906:33–68, (1987).
McCurley et al., "Optical Control Of Enzymatic Conversion Of Sucrose To Glucose By Bacteriorhodopsin Incorporated Into Self–Assembled Phosphatidylcholine Vesicles", *Analytica Chimica Acta*, vol. 311:211–215, (1995).
Pum et al., "Deep UV Patterning Of Monolayers Of Crystalline S Layer Protein On Silicon Surfaces", *Colloids And Surfaces B: Biointerfaces*, vol. 8:157–162, (1997).
Spatz et al., "Mineralization Of Gold Nanoparticles In A Block Copolymer Microemulsion", *Chem. Eur. J.*, vol. 2(12):1552–1555, (1996).
Schmidt et al., "Metal Nanopartikeln Polymer Superlattice Films: Fabrication And Control Of Layer Structure", *Adv. Mater.*, vol. 9(1):61–65, (1997).

* cited by examiner

METHOD TO PREPARE THE PRODUCTION OF STRUCTURED METAL COATINGS USING PROTEINS

The invention relates to the production of thin metal layers and structures on substrate supports having a planar or three-dimensional structure, as are required, for example, for depicting writing or drawings. The method avoids printing techniques.

The field of application of the invention described is the production of finely structured elements on decorative films or other thin or thick materials which may be flexible or rigid at room temperature. Such materials provided with thin metal layers are customarily used as packaging material or for other decorative purposes, as advertising materials, in optical signal and information processing or in semiconductors technology and microelectronics as conductor plates and IC chip material or for recircuiting, e.g. on semiconductor substrates.

PRIOR ART, DISADVANTAGES OF THE PRIOR ART

Known methods and processes for producing such metallic structures on the materials mentioned can be classified roughly into two basic types. The classification into direct and indirect methods employed here is based on the first electrically conductive layer which is structured or applied in structured form on a substrate having a significantly lower conductivity. The known methods work either directly and subtractively (e.g. laser-induced ablation), directly and additively (chemical deposition from the gas phase—CVD, including laser-induced) or indirectly using a complicated combination of different process steps from the range of microlitho-graphic structuring methods (e.g. etching processes in the aqueous or gas phase). These methods are widely used in semiconductor technology.

Those techniques which utilize only a few process steps start out from a closed metal layer or a closed metal film on the respective substrate. These can be, for example, layers obtained by lamination in the case of thick layers (>5 $\mu$m) or layers produced by chemical and physical gas-phase deposition methods or combinations thereof in the case of thin layers. The latter methods typically require vacuum conditions and high voltages or chemically aggressive gases and reagents.

Starting from a closed metal covering as is always produced, the areas which are required and are therefore to be retained (structural elements) are covered with a protective layer and the part corresponding to the negative of the desired image is removed by etching. (Cf.: Menz, W.; Bley, P. (1993) Mikrosystem-technik für Ingenieure, Weinheim, New York, Basel, Cambridge: VCH). Relatively coarse structures can be obtained by simple cutting or stamping from a metal foil and adhesively bonded to the appropriate surface.

Likewise, again starting from a closed metallic layer, the negative image can be masked with opaque lacquer or paint or a masking layer can be applied by lamination, overprinting, adhesive bonding or in another way, leaving the image elements clearly exposed as shiny metallic areas. The latter technique restricts the usability of the patterns and structures produced solely for decoration and packaging purposes.

The industrially usable production of complex metallic structures in the micron and submicron range by means of a direct lamination or sputtering process is not known.

However, highly resolved, planar and also three-dimensional metallic structures can be produced on various materials by means of laser-induced chemical deposition (laser-assisted deposition—LAD, synonymously chemical vapor deposition—CVD).

However, these methods are, as mentioned above, tied to particular pressure or atmospheric conditions and can be used only for the manufacture of small batches down to a batch size of 1.

It is also possible to use combined methods. These are either printing methods, for example screen printing techniques, in which an auxiliary-containing metal paste is applied to the material and is then fixed to the substrate surface by remelting at elevated temperature (from about 200 to above 800 degrees Celsius). The resolution (smallest structure width) of such processes and thus the quality of the images obtained is limited. The relatively high temperature required for the remelting step for pastes for producing durable metallizations restricts the range of materials which can be utilized here to appropriately stable materials such as ceramics and glasses.

Printing and reproduction techniques using printing plates have, in the form of the LIGA technique, successfully found a place in the range of microstructuring methods (Becker, E. W. et al., Microelectronic Engineering 4: 35–56 (1986)). Here they are part of a complex sequence of individual steps. Due to the plate materials employed, their maximum lateral resolution is likewise restricted to structure widths in the $\mu$m range.

A method employing printing from plates has been described by Hockberger's research group for finely structured biomolecule deposition on glass surfaces for the purpose of redirecting cell growth (Soekarno, A. et al., Neuroimage, 1, 129–144 (1994); Lom, B. et al., J. Neuroscience Methods, 50, 385–397 (1993)). A microlithographically produced plate enables chemical surface modifications having a lateral resolution in the $\mu$m range to be carried out.

Pritchard et al. (Angew. Chemie, 107, 84–86 (1995)) achieved protein strip widths of 1.5 $\mu$m on an $SiO_2$ surface using a mask-aided photochemical activation process.

The deposition of inorganic molecules and their ordered arrangement in crystalline form is a principle which has already been used in biology by "primitive" microorganisms. Higher life forms employ the same principle to provide themselves with a protective shell, a supporting skeleton or even teeth. The use of these principles for industrial applications is being stimulated by, inter alia, Mann et al., (Science 261, 1286–1292 (1993)). These authors likewise present a method of enriching ferritin monolayers with iron oxide. However, the known methods have hitherto not led to crystallization of metals at localized deposition sites determined by proteins.

Metallization of supramolecular lipid structures is also known. It was found to be possible to metallize the surfaces of helical super-structures (Schnur, J. M., Science 262, 1669–1676 (1993)).

It is an object of the present invention to provide a method in which, to produce laterally very finely structurable, metallic layers on any materials having a flat or three-dimensional surface, the necessary metallic, previously reduced or reducible material can be applied in a targeted way with very high accuracy to the site of deposition. This method should preferably do without the use of environmentally harmful components.

This object is achieved by applying a layer consisting of or comprising proteins to the substrate to be coated, wherein under illumination (action of light) in an appropriate environment the protein or proteins of the layer build up (form) a vectorial gradient of a physical or chemical property between two compartments formed by the layer and the change in the physical or chemical property effected in this way in one of the two compartments results in metal ions being reduced to metal or being accessible to a future reduction, after which the substrate provided with the protein-containing layer is illuminated at those places where the metal is to be deposited (positive illumination), or said change in the property results in a metal deposit already present being removed (etched away) at the illuminated areas of the layer (negative illumination).

The subclaims relate to preferred embodiments of the invention.

The proteins used according to the invention are ones which can act as a "pump" for the formation of a gradient of a physical or chemical property directed counter to the equilibrium which is normally established. The "property" can be of a physical nature, e.g. an electron gradient, but it is preferably of a chemical nature. Examples of chemical gradients are pH or ion (cation or anion) gradients. The proteins can be natural proteins, proteins derived from natural proteins (e.g. gene-modified or chemically modified proteins) or synthetic proteins.

The formation of the concentration gradient should be able to be induced by means of light (photons). Examples of such proteins occur naturally. Bacteriorhodopsin is a molecule which acts as a "proton pump" under the action of light while an example of an anion pump is halorhodopsin (see Oesterheld, D., Israel J. of Chemistry 1995, 35: 475–494). Such proteins are generally referred to as "retinal proteins". They utilize, in principle, a cis-trans transition of a chromophore caused by absorption of light, as has been found in the case of alkenals such as the retinal of rhodopsin (visual purple of mammals) or the retinal of bacteriorhodopsin. Some "retinal proteins" utilize the energy gained to generate a concentration gradient, e.g. the above mentioned bacteriorhodopsin and halorhodopsin.

As mentioned above, the proteins to be used according to the invention can be gene-modified proteins derived from natural proteins. Small changes in the structure of the amino acid chain of the protein can sometimes effect a considerable change in function: for example, a mutant bacterium which produces a bacteriorhodopsin which is changed by only one amino acid and transports chloride ions is known (Sasahi et al., Science (1995), 269: 73–75).

To obtain the necessary compartmentalization of the environment of the protein, it is necessary either for a closed layer of protein to be deposited on the substrate or for a closed layer of a support material in which the protein molecules are embedded to be deposited. Since molecular pumps consisting of proteins usually also have to be effective at phase boundaries in nature and these usually consist of membranes, it is advantageous to use lipids as support material. The protein-containing layer therefore preferably comprises a mixture of lipids and proteins. The selection of the lipids is subject to no restrictions in principle; preference is given to phospholipids. For cost reasons, materials such as soybean lecithin or azolecitin are advantageously used. Of course, all phosphatidylcholines and their derivatives are suitable in principle.

The lipids can be deposited on the substrate as a two-dimensional layer in which the protein (or various types of protein) is embedded. An advantage of using lipids is their three-dimensional composition comprising a hydrophilic head and a hydrophobic tail, as a result of which the lipids arrange themselves in a parallel way (head-head and tail-tail). The protein, e.g. bacteriorhodopsin, will arrange itself with a preferred direction in such a layer. To maintain the action of the molecular pump even in the macro range, it is of course absolutely necessary for more than half of the molecular pumps to act in one direction. A stochastic distribution would lead to elimination of the effect.

It is particularly preferred for the protein-containing layer to consist of or comprise lipid vesicles (liposomes) in which the protein is embedded. Here, the compartments between which the gradient is formed are the outer surroundings of the vesicle and its interior. If bacteriorhodopsin is incorporated into the vesicle, it arranges itself in the artificial membrane in such a way that the pumping function can, unlike the situation in nature, also operate "inside-out". In this way, metal ions either in the immediate vicinity of the vesicle or in its interior can in each case be reduced or changed in such a way that they are accessible to reduction. The result is the localized, defined deposition of these metal atoms. In place of reduction of the metal ions (direct reduction or change in the metal-containing molecule, e.g. an organometallic complex, so that it becomes available to reduction), it is also possible to employ other routes which are customary in metal deposition technology, e.g. sensitization (example: tin(II) chloride is converted into tin(II) hydroxide which is oxidized in a palladium(II) salt bath so as to precipitate palladium metal).

If the proton pump or other chemical pump acts in the opposite direction (e.g. by lowering the pH), its illumination will lead to the reverse effect. For this reason, such arrangements are suitable for the etching away of existing metal layers on the substrate. Instead of direct etching, it is also possible, in this variant, to activate a metallic or nonmetallic auxiliary, e.g. a different alkali- or acid-unstable compound, which then in turn effects etching.

The protein molecules have to remain fixed in position from the time of illumination. This can be ensured by embedding them in the layer applied to the substrate. In a particularly preferred embodiment, the proteins additionally possess an "anchor", i.e. they are held on the substrate by means of van der Waals or other forces, e.g. chemical forces.

The layer consisting of or comprising proteins has to be arranged in an environment which allows the formation of a concentration gradient. Thus, when using a proton pump it is necessary for a sufficient number of water molecules to be present in both compartments. Preferably, an aqueous solution in which the metal ions are present in the form of a metal salt is located within the vesicles or below the two-dimensional layer ("two-dimensional" here refers to a layer which consists solely of essentially adjacent particles but can be configured either as a single layer or as a multilayer). The outside of the vesicles (or the side of the two-dimensional layer facing away from the substrate) should likewise be covered by an aqueous solution in which the appropriate metal ions can be present. It is sufficient for a thin layer of this solution to cover the vesicles, which can be achieved, if desired, by means of a "humid chamber".

If vesicles are used, the local concentration gradient as described above either in the interior of the vesicles or on their outsides depending on the selected conditions may be suitable for effecting or preparing for the reduction or etching away. If the former is the case, the vesicles naturally have to be destroyed or opened for the desired effect to be achieved. This can be done by means of customary methods, including the removal of the lipids and proteins.

The metal ions which can be used according to the invention may be selected as a function of the material to be deposited. Preference is given to selecting tin or transition metals which can, for example, be complexed. Apart from inorganic complexes, it is also possible to use organometallic compounds. Protonation of such compounds leads to free radicals which decompose to metal or metal oxide. Such free radicals may be hydrolyzed relatively slowly, i.e. may be relatively long-lived. Otherwise, or in addition, they can be stabilized, e.g. by packing them in micelles.

According to the invention, it is also possible to increase the viscosity of the metal ion solution. This measure can contribute to keeping the proteins in fixed positions. The viscosity can be increased by customary means, e.g. by addition of polyvinylpyrrolidone or polyvinyl alcohol.

The surface of the substrate can be electrically conductive or nonconductive; the effectiveness of metal deposition or etching is independent of this.

The deposition of metal which prepares for the production of structured metal layers does not have to form a deposit which covers the surface. It is sufficient to deposit crystal nuclei of the metal on the substrate surface. This enables highly precise deposition boundaries to be achieved (in the region of the wavelength of the light used). The crystal nuclei can be catalytically active in the deposition of further material in subsequent steps.

Furthermore, the method of the invention makes it possible to obtain three-dimensional structures of the metal to be deposited.

Thus, in the method of the invention, a homogeneously covered substrate surface is used as the starting point and is covered with a light-sensitive protein layer as described above, after which the desired pattern to be reproduced or the desired structure is written/drawn on by means of appropriate illumination, if desired using a focused light source, or projected using a suitable photomask.

The method of the invention can in many cases be carried out at room temperature. If naturally occurring proteins are used, preference is given to employing a temperature which corresponds to that of the natural environment of the protein.

In the subsequent step of a specific embodiment of the invention, which may, if desired, be carried out only after intermediate storage of the prepared (illuminated) materials, a metallic layer is deposited from a liquid phase at the places on the material which have been changed by illumination (image elements). After appropriate intermediate steps for avoiding undesired deposition of the layer at unintended places on the substrate—to increase contrast—this layer is used for further metallization.

The method of metallization using molecules whose optical properties can be changed or complex mixtures of such molecules is also suitable for producing three-dimensional structures. These structures, which can be regarded as comprising a plurality of individual layers joined to one another in a complex fashion or constituents of such layers can be produced by targeted irradiation with focused light at the appropriate places for metal deposition in a three-dimensional substrate which may be homogeneous or inhomogeneous in terms of its material composition and/or structure. Such a substrate can be, for example, a sol, a gel, a glass or a monolithic or porous solid, for example a crystal compact similar to a sugar cube. From a complex, three-dimensional layer structure formed in the described sense, the underlying substrate whose surface has been utilized for deposition of the layer can be removed again either completely or partially (e.g. by dissolution in a suitable solvent). This leaves, in the case of the simple removal of a planar substrate, a finely structured planar layer of the deposited material, or else a complex, three-dimensional structure. This structure then consists of a metallic material or a material comprising a metallic component.

In each case, in this embodiment of the invention, a layer of molecules and possibly auxiliaries is present on the surface of or in the substrate and this layer leads, by means of a light-addressed change in the properties of a significant constituent of the layer, to formation of areas of preferred metal deposition during the course of subsequent processes.

A further embodiment of the invention exploits the particular properties of a substance which acts as a molecular pump, for example the bacteriorhodopsin molecule which can be isolated from bacterial biomass. The targeted deposition of a monolayer of such molecules is here utilized for highly resolved local corrosion or modification of the substrate underneath in a liquid medium. The molecule referred to as a "pump" has the ability to transport substances, for example protons ($H^+$) or ions, selectively under the action of light from the solution side to the substrate side through a layer which serves simultaneously as support and barrier. By means of these factors attained in the immediate vicinity of the substrate surface, a structuring of the substrate surface is carried out. The structuring can lead only to creation of otherwise undetectable defect sites. In a subsequent step, which is carried out only after removal of the layer containing "pumps" which have been partially activated optically, a further structuring or other alteration of the material is carried out. This can be isotropic or anisotropic etching or the formation of a layer, for example by crystallization of a substance which then comes into contact with the substrate from a solution, a suspension or a gas.

Advantages of the method of the invention can be summarized as follows: the locally highly resolved deposition of the primary metallic layer which is later catalytically active or directly active as crystallization nucleus at the location of molecules which have been altered beforehand by optical means allows precision in the region of the wavelength of the light used, but at least, if appropriate, in the region of the vesicle size. The use of focused light, for instance that of a laser beam, and the simplicity of the procedure allows metallization to be carried out both in and under porous layers. Here, identical or different planar metallizations superposed in a plurality of layers can be electrically connected via predetermined bridges. Combining suitable parameters makes it possible to build up planar and three-dimensional structures comprising two or more different metals. Such complex metallization structures can be used as high-density recircuiting structures. Method-determining parameters are given by the optical absorption properties of various proteins or other light-sensitive substances mixed with them, and/or the timedelayed incubation with solutions of different metals, or the controlled reaction kinetics in complex solutions and mixtures. The lateral extent of a metallic layer on the respective substrate can be predetermined with a precision in the micron and submicron range. The method described makes it possible to produce flat and three-dimensional metal structures on smooth, planar or curved, electrically conductive or nonconductive surfaces.

The latter preferred embodiment of the method of the invention (production of structured materials or layers) is based on the same principle of the optically addressable targeted modification of a layer suitable for this purpose on a surface.

The method of the invention makes it possible to achieve, for example, a decorative, shiny metal layer for writing on surfaces.

The abovementioned embodiments of the invention can be utilized for building up complex layers and structures. Here, the material which finally dominates the structure produced can have a different material composition than the underlying substrate surface or the substrate itself.

The metals or metal ions which can be used according to the invention can be selected from among tin and the group consisting of transition metals or transition metal ions, in particular from among tin, iron, chromium, rhodium, nickel, palladium, platinum, iridium, gold and/or rhenium. The metal ions can be in the form of inorganic compounds, e.g. as protonatable organometallic compounds of nickel, palladium and/or platinum.

BRIEF DESCRIPTION OF THE DRAWINGS

The accompanying figures illustrate the inprinciple procedures described. In the figures:

In FIG. 1, the reference numeral 1 denotes a supporting/fixing auxiliary (e.g. lipid), 2 denotes a photoactive molecule, such a molecule composite or cluster, 3 denotes the substrate; 4 represents crystallization nuclei and 5 represents a deposited metal layer. The sequence of steps shows, from the top down, the substrate 3 alone, the substrate with deposited layer of photoactivatable molecules in a supporting matrix, the selective illumination (hv) of a photoactivatable molecule or molecule composite (dry or wet), the primary metallization effected thereby to form crystallization nuclei and, in the bottom row, the secondary metal deposition.

FIG. 3 shows, likewise from the top down, the etching procedure, where the substrate (drawn in as a broken line) with a metal layer deposited thereon ("primary layer") drawn in as a continuous, thicker black line) is coated in the second row with monolayers of photoactivatable molecules in a support (support function). Selective illumination induces local pH gradients, recognizable by defects in the metal layer which are enlarged by biomimetic corrosion (4th row). Removal of the photoactivatable molecules stops the corrosion (last row).

Figure 1:
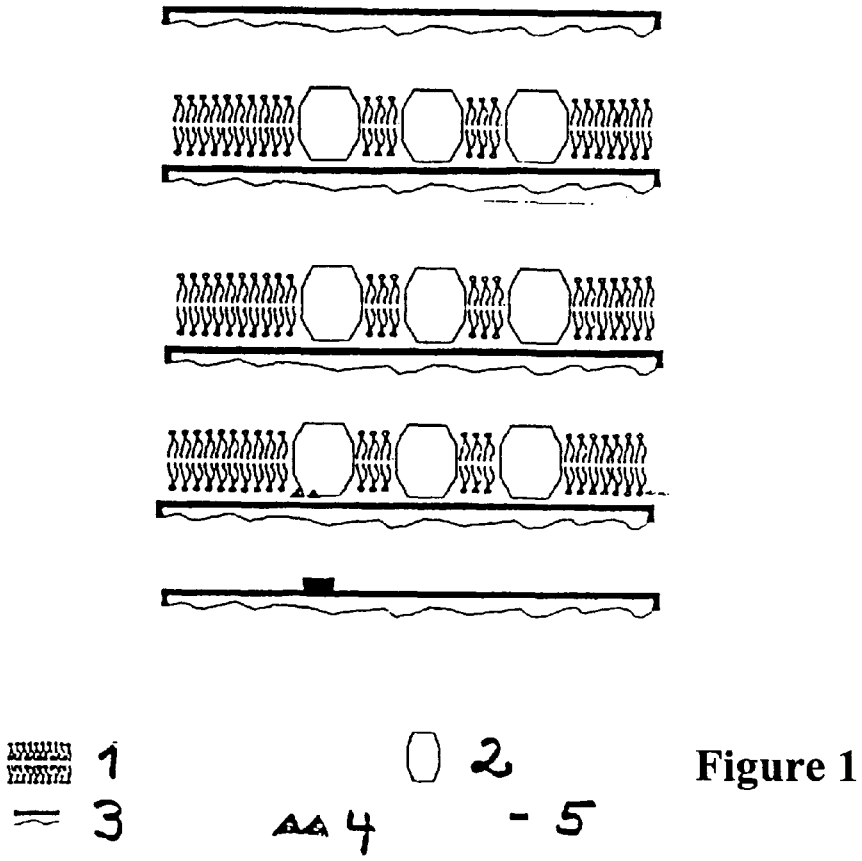
FIG. 1 shows the sequence of steps of a photo-addressed metallization.
Figure 2:
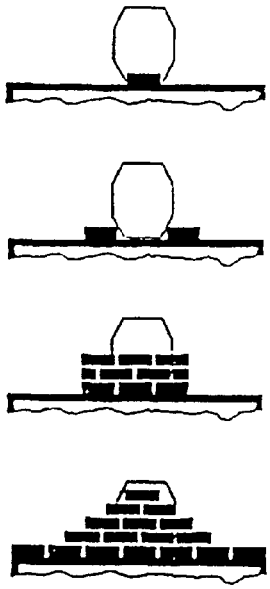
FIG. 2 illustrates the precision of the deposition of the layer.
Figure 3:
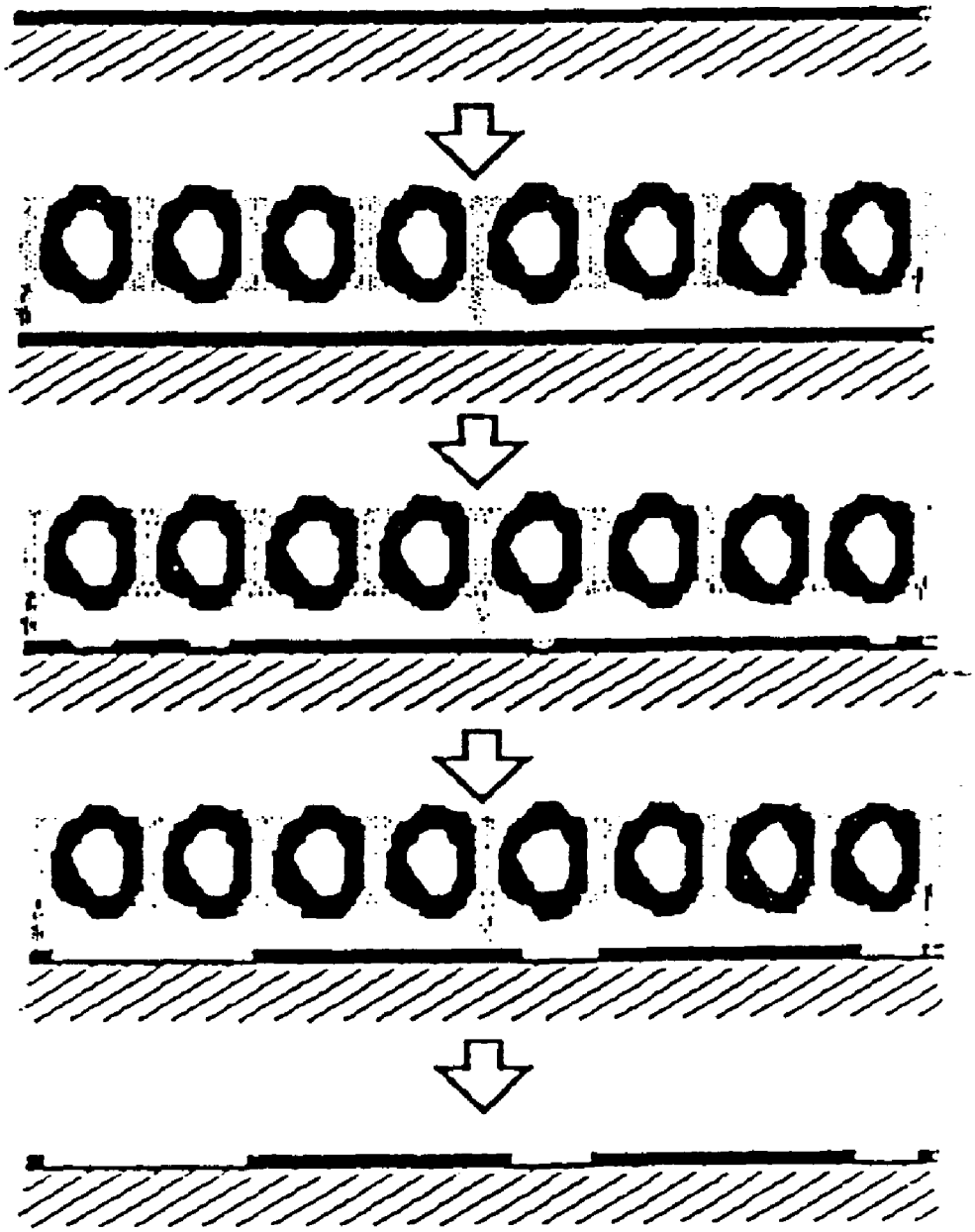
FIG. 3 shows the sequence of steps of a fine etching technique aided by a "molecular pump".

The invention is illustrated below by means of examples.

1. General

Liposomes containing stabilized metal ions in solution in the enclosed, internal liquid pool and bacteriorhodopsin molecules (BR) oriented in a preferred direction (vectorially) in their lipid membrane are prepared. A dispersion of such liposomes is applied as a closed, thin layer to the substrate to be provided with a metal structure and is partly illuminated with the aid of an appropriate photomask. At the places which are illuminated, the pH of the liquid encapsulated in the liposomes changes as a result of the activity of the molecular proton pump BR. The shifts over time of the pH triggered in this way are utilized for modifying the solution of the encapsulated metal salt. Depending on the type of complexes, metal salts can be destabilized and partially or completely altered in this way. The associated modifications of the liposome contents are utilized in subsequent steps to partly activate the substrate by customary methods of chemical (=autocatalytic=electroless) metallization. This activation comprises the deposition of metal nuclei. Such metal nuclei are then utilized, by means of customary methods of chemical or electrochemical metallization, for producing electrically conductive structures, including structures of metals other than that of the salts and/or complexes used initially.

The principle described, namely optically manipulating components of known activation or metallization baths encapsulated in liposomes by means of light-driven molecular proton pumps so as to lead to partial chemical contrasts which correspond to the optical contrasts utilized for manipulation, can, depending on the components used and their orientation in the liposome membrane (e.g. BR), give both negative and positive images of the illumination patterns.

2. Typically, the Following Working Steps can be used

The amount of lipid required for the preparation of a 0.1–0.5% strength lipid suspension is weighed into a test tube and, together with a 0.01–1 mM solution of a salt or complex of a metal (for example 100 $\mu$M palladium(II) chloride), suspended by customary methods with the aid of an ultrasound generator in a 0.01–5 M salt solution of a chloride, sulfate, carbonate, nitrate or phosphate whose pH can be set to values around or below pH 8 (for example 0.5 M potassium sulfate). While cooling constantly in a (tap water) cooling bath, a clear, slightly opalescent liposome dispersion can be obtained within about 10 minutes, depending on the power used. The prepared liposome dispersion is added to a solution of the BR (bacteriorhodopsin) intended for reconstitution in the liposome membrane. The "incorporation" of the BR into the liposomes is again carried out by means of a titanium probe of an ultrasound generator over a period of about 3 minutes, but can also be carried out in another way, as customarily employed in various variants in biochemistry, biophysics or medicine. To evaluate the (oriented reconstitution of the BR in the) BR-metal salt-liposome preparation obtained, an aliquot is irradiated with yellow light (1>500 nm) in a glass cell while mixing continuously. The effective preferential orientation of the BR molecules in the vesicle membrane and the pumping rate achieved are concluded from the readily measured change in the pH in the external volume (combination pH electrode). Suitable preparations are ones which induce pH changes of about 0.1 pH units under illumination.

To increase the viscosity of the dispersion, it is possible to add polymers, for example polyvinyl-pyrrolidone (PVP) or polyvinyl alcohol (PVA). It is thus possible to apply, for example, a 7.5% strength PVPliposome dispersion as a thin film to the substrate, for example using a spin coater customary in microelectronics technologies. The substrate which has been prepared in this way is then illuminated through the photomask with yellow light (1>500 nm) in a humid atmosphere ("humid chamber"). The illuminated substrate is then dried in a hot air oven and is then available for conventional chemical metallization, for example with a nickel-boron layer (NiB).

3. Example 5 mg of azolectin (Sigma-Aldrich) are sonicated for 15 minutes in 5 ml of an aqueous 100 $\mu$M tetrammine palladate solution in 0.5 M potassium sulfate in a test tube using the titanium probe of an ultrasound generator (Branson Sonifier W 450). The clear, slightly opalescent dispersion is admixed with a bacteriorhodopsin solution in a molar ratio of lipid- :protein of 700:1 and sonicated for a further 3 minutes while avoiding strong cavitation. Polyvinylpyrrolidone (molecular weight about 350,000-SERVA) is added to 7.5 percent by weight and completely dissolved with stirring (Vortex). This slightly syrupy solution is applied in a thin layer to the substrate to be coated, for example a glass fiber-reinforced epoxy material (FR-4 printed circuit substrate material). A photomask is projected by means of yellow light (Schott filter OG 515) onto this layer using a suitable optical arrangement. To prevent drying-out of the liposome layer, the last-named step is carried out in an atmosphere saturated with water vapor. For this purpose, the substrate is present in a "humid chamber". After illumination, the substrate is dried in a hot air oven. This is followed by conventional NiB deposition.

The invention will be summarized once more below, with additional, specific embodiments being mentioned: It relates to a process for producing structured metal layers on surfaces or their preparation, in which, starting from protein molecules adhering to the surface of a solid, the properties of the protein molecules are changed locally and thus are compared to the unchanged protein molecules on the layer at the site of the deposition of metal from a solution or suspension and/or the binding of colloidal metal particles or atomic clusters from a liquid containing them or a gas or a gas mixture, a protein layer or constituents of such a layer arranged with molecular resolution serves as initiator of a reaction at a surface which is wetted by a solution or is brought into contact with a defined gas composition, a local concentration gradient of at least one component in the liquid or the gas phase in the immediate vicinity of particular protein molecules can represent a significant influencing parameter for controlling the deposition process, light of a discrete wavelength from the spectrum of visible light is a factor which modifies the character of the protein molecules adhering to the surface, the conformation of a polymeric component comprising various amino acid groups as structural units and located at the site intended for the deposition of metal represents a parameter which determines the metallization process.

Furthermore, the invention encompasses embodiments in which

- structured metal layers are produced on surfaces in contact with a liquid phase, as disclosed above, where bacteriorhodopsin or a derivative thereof or a variation thereof represents the protein component in the layer or is a significant constituent of the layer,
- a protein mixture or a mixture of proteins with further molecules capable of various conformations is used for forming the layer,
- the layer is stabilized by a type of molecule which is chemically inert under the further conditions,
- discrete regions of the primary protein-containing layer absorb light of different wavelengths at different times or synchronously,
- discrete regions of a primary nonmetallic layer are excited by light of defined wavelength and/or are locally changed in their properties,
- the liquid phase can comprise the salt of a metal to be deposited in dissolved form,
- the liquid phase represents a colloid of very small (>200 nm diameter), charged particles,
- the liquid phase can comprise a metal colloid,
- the composition of the liquid phase changes over the duration of contact with the substrate,
- the properties of the components which lead to formation of a metal layer and are present in the liquid are stabilized by the presence of other dissolved substances or are improved for the intended purpose of deposition of a layer,
- the surface intended for deposition of the metal layer can be covered by a porous layer,
- the surface intended for deposition of the metal layer can represent the internal surface of a porous material,
- the surface intended for deposition of the metal represents the surface of a material which can be shaped at room temperature or at elevated temperature,
- the substrate which serves as a base for formation of the layer and is solid under the conditions of the deposition of the layer can be partly or completely removed, replaced by another material or supplemented in a subsequent step without complete destruction of the metallic structure which has been deposited,
- a laterally structured metal layer prescribes the surface arrangement of a primary material which aids the deposition of a further metal,
- the finely structured metal layer obtained serves for purposes of constructing a circuit and conducting electric current,
- the finely structured metal layer obtained is used as graphic image element or text constituent,
- the metal structure obtained is used for measurement or as a sensor,
- the metal structure obtained is used in the field of automobile or vehicle construction, the metal structure is produced by means of a molecular pump which is activated by selective illumination or by means of another principle which produces a local concentration gradient,
- the formation of the metal layer proceeds to completion at the locations of the previous light-activated protein molecules whose properties can be controlled.

What is claimed is:

1. A method of preparation for the production of structured metal layers on substrate surfaces, comprising the following steps:

(a) application of a layer comprising proteins to the substrate surface, where the protein or proteins of this layer is/are selected from among proteins which, under the action of light, form a cation or anion concentration gradient between two compartments formed by the layer and the change in the ion concentration effected in this way in one of the two compartments results in metal ions or compounds present there being reduced to metal or being accessible to a future reduction, and (b) differential illumination of the substrate provided with the protein-containing layer.

2. The method according to claim 1, wherein the cation or anion concentration gradient is a pH gradient.

3. The method according to claim 1, wherein the protein-comprising layer comprises protein selected from the group consisting of retinal protein, natural bacteriorhodopsin, modified bacteriorhodopsin, natural halorhodopsin, and modified halorhodopsin.

4. The method according to claim 1, wherein the illumination is effected by means of light having a discrete wavelength.

5. The method according to claim 1, wherein the protein-containing layer comprises a mixture of lipids and proteins.

6. The method according to claim 5, wherein the protein-containing layer is a two-dimensional layer of lipids with proteins present therein.

7. The method according to claim 5, wherein the protein-containing layer consists of or comprises lipid vesicles or liposomes into whose walls proteins are incorporated.

8. The method according to claim 1, wherein the metal or the metal ions are selected from the group consisting of a transition metal, transition metal ion, tin, tin ion, iron, iron ion, chromium, chromium ion, rhodium, rhodium ion, nickel, nickel ion, palladium, palladium ion, platinum, platinum ion, iridium, iridium ion, gold, gold ion, rhenium, and rhenium ion.

9. The method according to claim 1, wherein the metal ions in the form of inorganic or organic complexes or of organometallic compounds.

10. The method according to claim 9, wherein the metal ions in the form of protonatable organometallic compounds of nickel, palladium and/or platinum.

11. A method of preparation for the production of structured metal layers on substrate surfaces, comprising the following steps:

(a) application of a layer comprising proteins to a substrate surface coated with metal, where the protein or proteins of this layer is/are selected from among proteins which, under the action of light, form a cation or anion concentration gradient between two compartments formed by the layer and the change in the ion concentration effected in this way in one of the two compartments results in the metal being oxidized from the coating and being brought into solution, and (b) differential illumination of the substrate provided with the protein-containing layer.

12. The method according to claim 11, wherein the cation or anion concentration gradient is a pH gradient.

13. The method according to claim 11, wherein the protein-containing layer comprises a protein selected from the group consisting of retinal protein, natural bacteriorhodopsin, modified bacteriorhodopsin, natural halorholopsin, and modified halorholopsin.

14. The method according to claim 11, wherein the illumination is effected by means of light having a discrete wavelength.

15. The method according to claims 11, wherein the protein-containing layer comprises a mixture of lipids and proteins.

16. The method according to claim 15, wherein the protein-containing layer is a two-dimensional layer of lipids with proteins present therein.

17. The method according to claim 15, wherein the protein-containing layer comprises lipid vesicles or liposomes into whose walls proteins are incorporated.

18. The method according to claim 11, wherein the metal or the metal ions are selected from the group consisting of transition metal, transition metal ion, tin, tin ion, iron, iron ion, chromium, chromium ion, rhodium, rhodium ion, nickel, nickel ion, palladium, palladium ion, platinum, platinum ion, iridium, iridium ion, gold, gold ion, rhenium, and rhenium ion.

19. The method according to claim 11, wherein the metal ions are in the form of inorganic or organic complexes or of organometallic compounds.

20. The method according to claim 19, wherein the metal ions are in the form of protonatable organometallic compounds of nickel, palladium and/or platinum.

* * * * *